US005368511A

United States Patent [19]

James

[11] Patent Number: 5,368,511

[45] Date of Patent: Nov. 29, 1994

[54] WATER SLED

[76] Inventor: Paul L. James, 1675 C Greencastle, Rowland Heights, Calif. 91748

[21] Appl. No.: 99,473

[22] Filed: Jul. 30, 1993

[51] Int. Cl.[5] ..... B63B 1/00

[52] U.S. Cl. ..... 441/65; 441/129; 441/35

[58] Field of Search ..... 114/39.1, 61, 357; 441/73, 45, 129, 65, 35

[56] References Cited

U.S. PATENT DOCUMENTS 2,950,923 8/1960 Forney ..... 441/73

4,915,047 4/1990 Lord et al. ..... 114/39.1

5,056,448 10/1991 Miller, Sr. ..... 114/61

*Primary Examiner*—Jesus D. Sotelo

*Attorney, Agent, or Firm*—E. Michael Combs

[57] ABSTRACT

A water sled is arranged for towing behind a self-propelled boat such as a ski boat and the like. A plurality of spaced parallel buoyancy tubes include removable caps to provide for reception of ballast within each respective buoyancy tube to accommodate tilting of cargo positioned upon a support web mounted within a rectinilear buoyant framework tube structure secured upon the first and second buoyancy tubes.

2 Claims, 4 Drawing Sheets

WATER SLED

BACKGROUND OF THE INVENTION

1. Field of the Invention

The field of invention relates to sled structure, and more particularly pertains to a new and improved water sled arranged to accommodate cargo for water transport.

2. Description of the Prior Art

The advent of the various "jet ski" as a recreational vehicle is known, wherein such jet ski structure having limited available space requires repeated trips by a user thereof in the transport of cargo. The instant invention attempts to overcome deficiencies of the prior art by providing for a sled structure arranged to transport cargo in association with a self-propelled vehicle as noted above and in this respect, the present invention substantially fulfills this need.

SUMMARY OF THE INVENTION

In view of the foregoing disadvantages inherent in the known types of water sled structure now present in the prior art, the present invention provides a water sled wherein the same is directed to the transport of cargo thereon and towed by an associated self-propelled motor vehicle. As such, the general purpose of the present invention, which will be described subsequently in greater detail, is to provide a new and improved water sled which has all the advantages of the prior art water sled and none of the disadvantages.

To attain this, the present invention provides a water sled arranged for towing behind a self-propelled boat such as a ski boat and the like. A plurality of spaced parallel buoyancy tubes include removable caps to provide for reception of ballast within each respective buoyancy tube to accommodate tilting of cargo positioned upon a support web mounted within a rectilinear buoyant framework tube structure secured upon the first and second buoyancy tubes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water sled which has all the advantages of the prior art water sleds and none of the disadvantages.

It is another object of the present invention to provide a new and improved water sled which may be easily and efficiently manufactured and marketed.

It is a further object of the present invention to provide a new and improved water sled which is of a durable and reliable construction.

An even further object of the present invention is to provide a new and improved water sled which is susceptible of a low cost of manufacture with regard to both materials and labor, and which accordingly is then susceptible of low prices of sale to the consuming public, thereby making such water sleds economically available to the buying public.

Still yet another object of the present invention is to provide a new and improved water sled which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
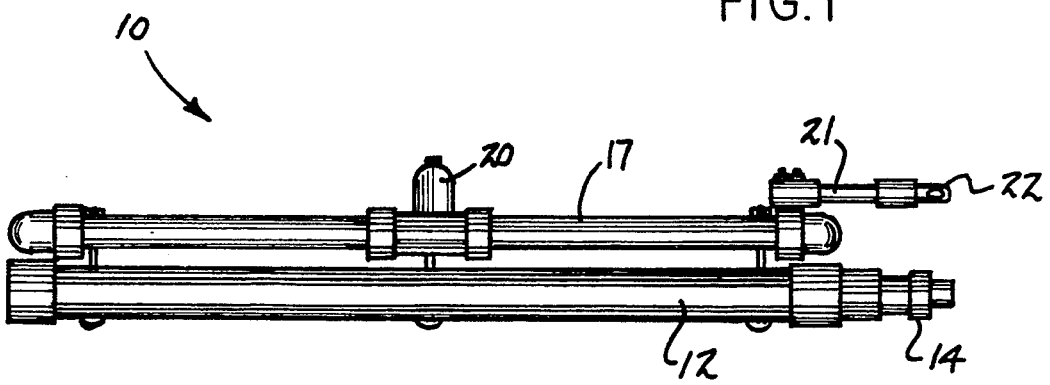
FIG. 1 is an orthographic side view of the invention.

With reference now to the drawings, and in particular to FIGS. 1 to 8 thereof, a new and improved water sled embodying the principles and concepts of the present invention and generally designated by the reference numerals 10 and **10*a*** will be described.

Figure 2:
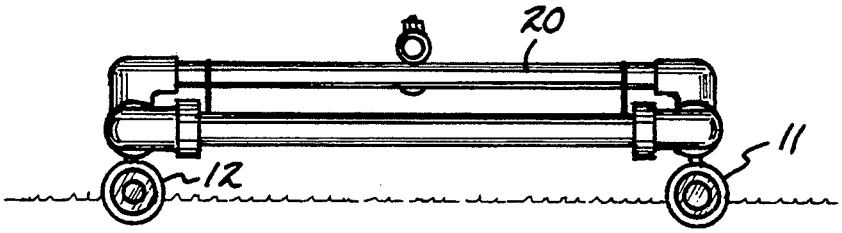
FIG. 2 is an orthographic frontal view of the invention.
Figure 3:
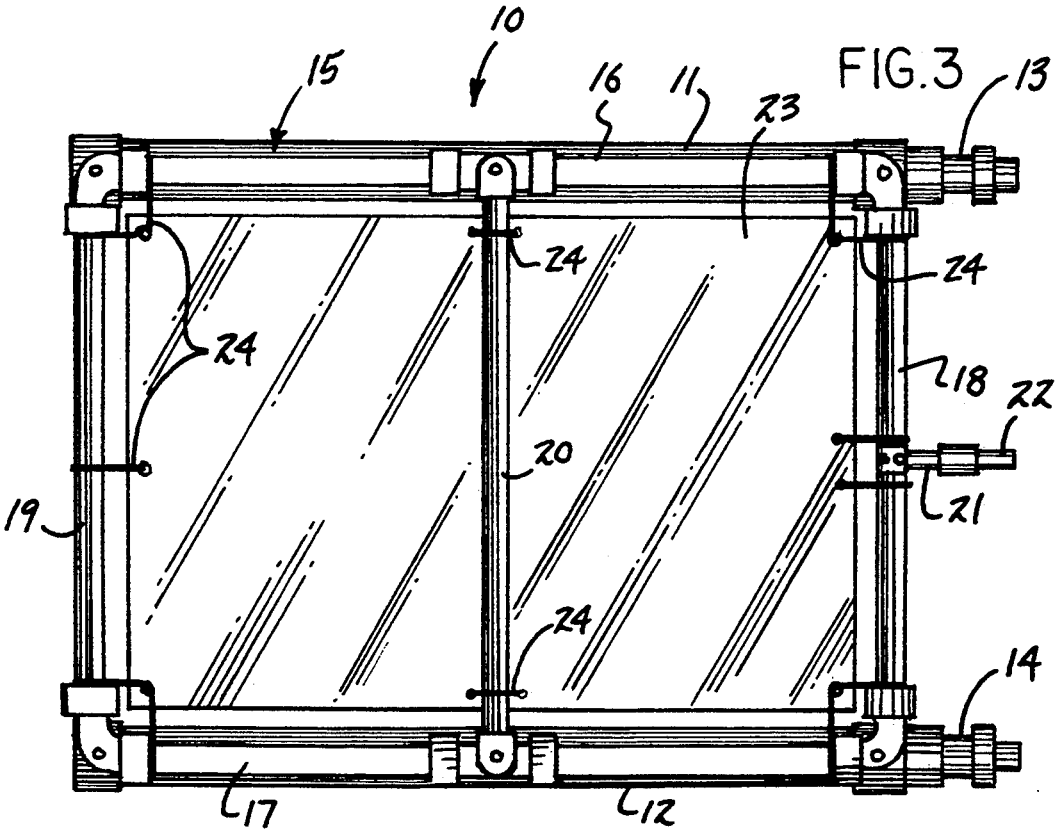
FIG. 3 is an orthographic top view of the invention.
Figure 4:
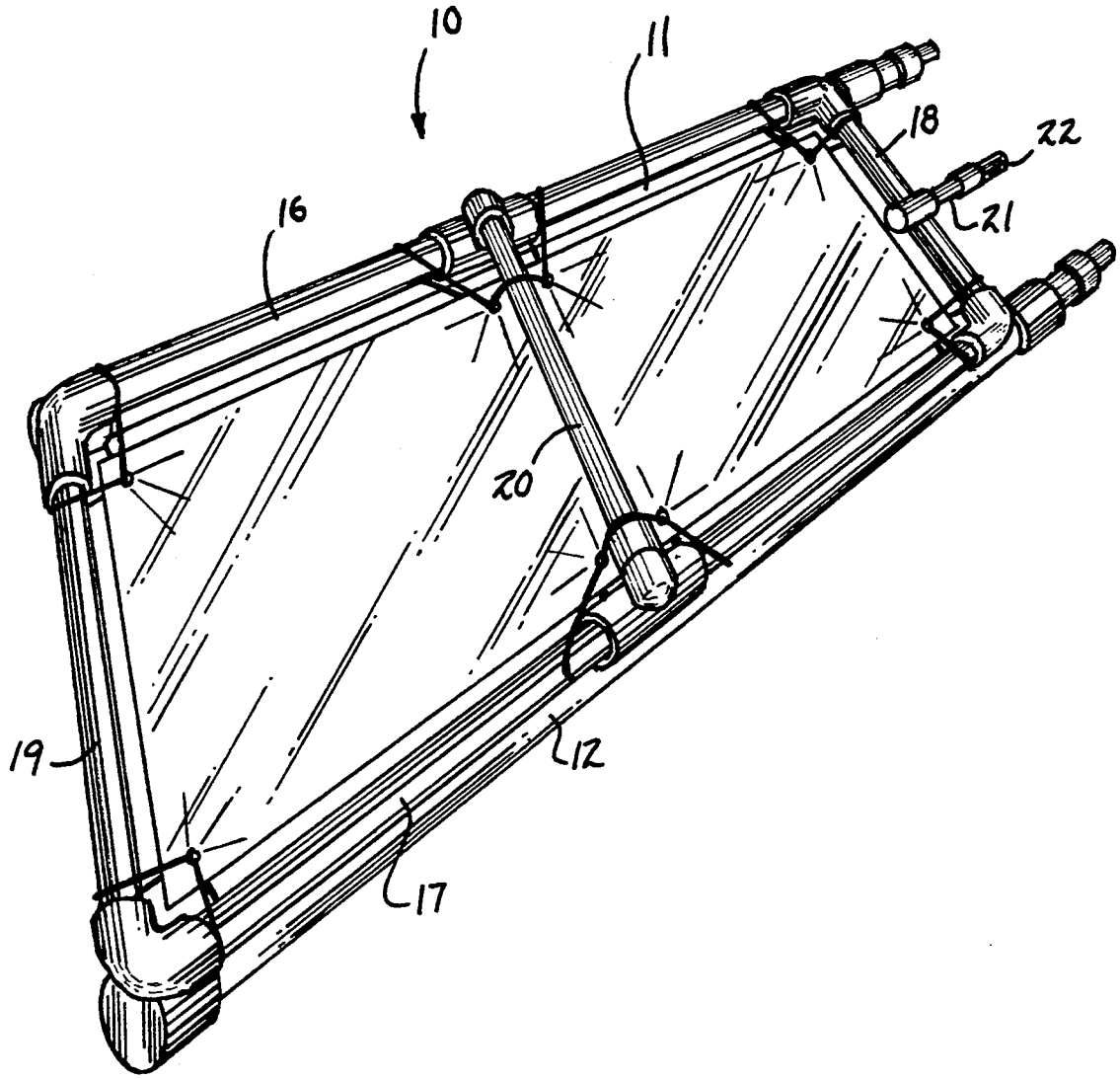
FIG. 4 is an isometric illustration of the invention.

More specifically, the water sled 10 of the instant invention essentially comprises first and second buoyancy tubes 11 and 12 arranged in a parallel coextensive relationship relative to one another, as indicated in the FIGS. 1–3, having respective first and second removable caps 13 and 14. The removable caps permit access interiorly of the first and second respective tubes 11 and 12 permitting filling of ballast within the respective tubes, such as sand and the like, to permit the balancing of cargo asymmetrically mounted upon an associated support web 23 of the structure. The first and second buoyancy tubes 11 and 12 have secured thereon a tubular support frame 15 of a generally rectinilear construction, having first and second frame tubes 16 and 17 mounted in a parallel relationship positioned over the respective first and second buoyancy tubes 11 and 12. Third and fourth frame tubes 18 and 19 extend orthogonally relative to the first and second frame tubes 16 and 17 and parallel relative to one another to define a rectilinear frame. A fifth frame tube 20 orthogonally directed between the first and second frame tubes 16 and 17 is spaced above the rectilinear frame structure for use as a handle and as a means of dividing the support web 23 mounted within the rectilinear frame defined by the first to fourth frame tubes. The support web 23 is secured to the rectilinear frame by a plurality of tether lines 24. The fifth frame tube 20 further affords the use as a handle structure during manipulation of the structure during periods of non-use and transport thereof.

A connecting rod 21 orthogonally extends from the third frame tube 18 parallel to and medially of the first and second buoyancy tubes terminating in a tow loop 22 permitting attachment of the organization in a convenient manner and associated to a vehicle (not shown).

Figure 5:
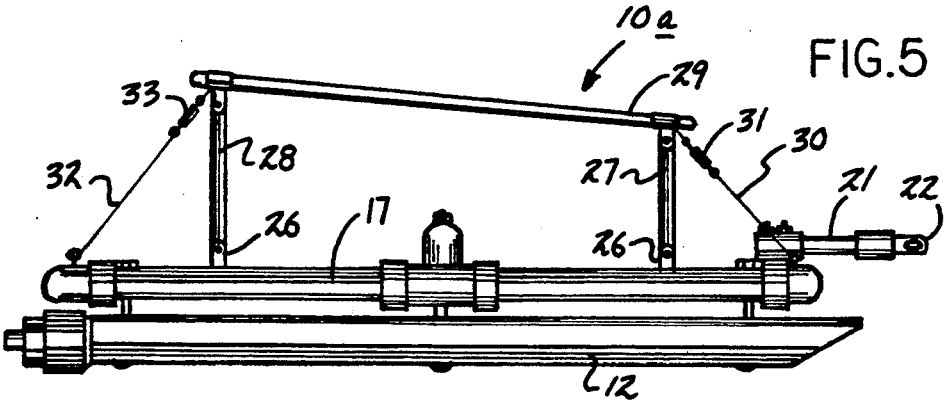
FIG. 5 is an orthographic side view of a modified aspect of the invention employing a water shield.
Figure 6:
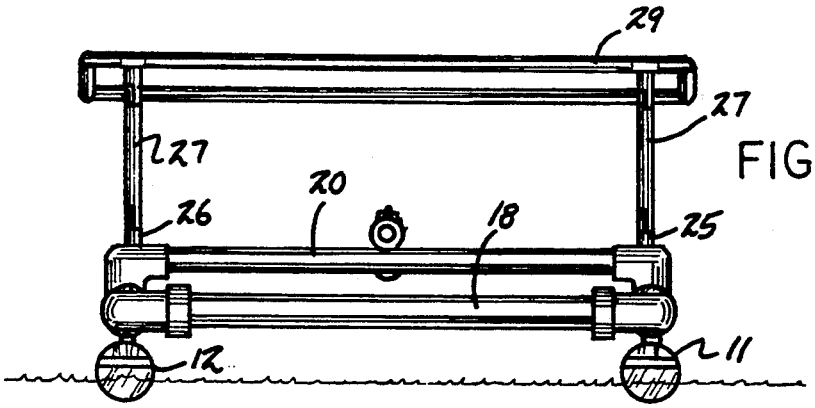
FIG. 6 is an orthographic frontal view of the invention.
Figure 7:
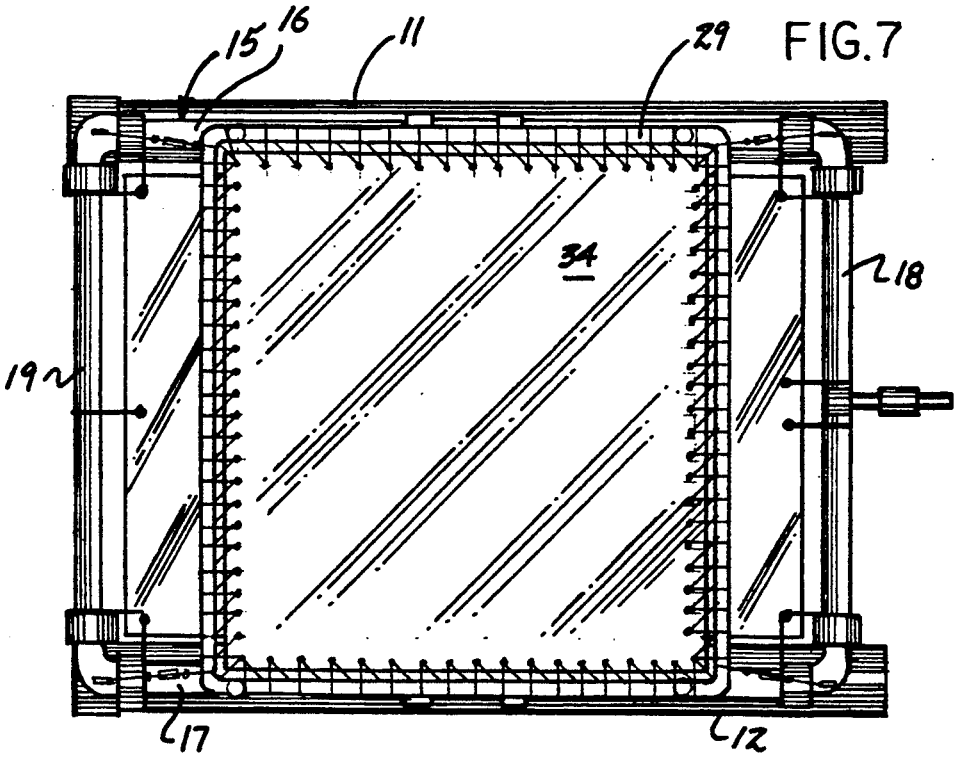
FIG. 7 is an orthographic top view of the invention indicated in the FIGS. 5 and 6.
Figure 8:
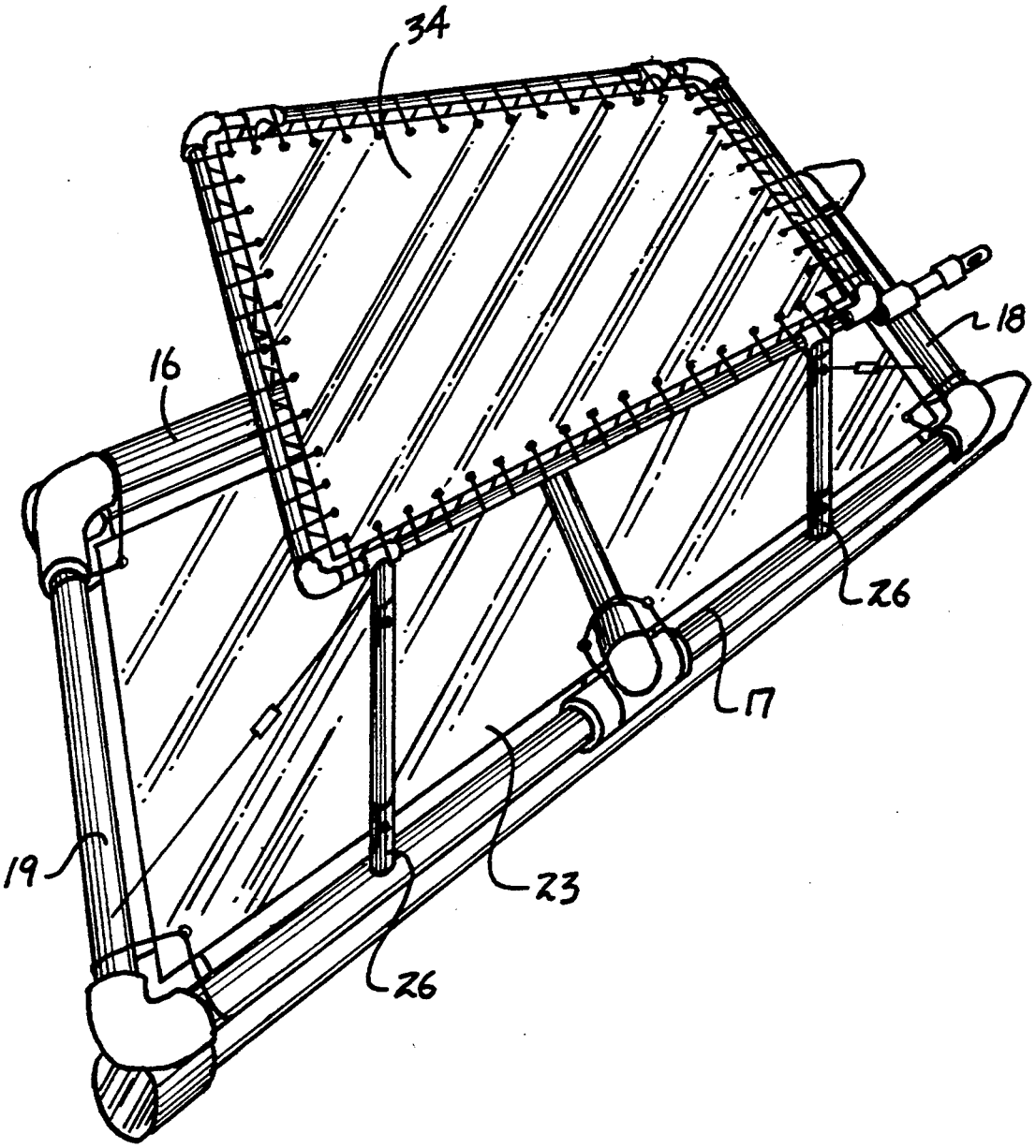
FIG. 8 is an isometric illustration of the invention as indicated in the FIGS. 5–7.

The FIGS. 5–8 indicate the use of first anchor legs 25 fixedly and orthogonally mounted to the first frame tube in a spaced parallel relationship in a like manner as second anchor legs 26 that are fixedly and orthogonally mounted in a spaced parallel relationship to the second frame tube 17. One of the anchor legs 25 is positioned in spaced adjacency to the third frame tube, with a further of the first anchor legs mounted in spaced adjacency to the fourth frame tube, wherein a forward of the second anchor legs 26 is positioned in adjacency to the third frame tube, with a further of the second anchor legs spaced in adjacency to the fourth frame tube. The forward part of the first and second anchor legs 25 and 26 pivotally mount first post having a first length, with the rearward members of the second anchor legs 26 pivotally mounted each to a second post 28 of a second length, with each second post second length greater than said first length to support a continuous tarp frame 29 pivotally at an uppermost end of each of the first and second posts, with the tarp frame 29 having a continuous cover web shield 34 to deflect water spray and the like relative to cargo positioned upon the support web 23 as the shield 34 is canted downwardly towards the third frame tube 18, as indicated in FIG. 5 for example. Further, at least one first tether line 30 is directed from the frame 29 to the third frame tube, with a second tether line 32 directed from the tarp frame 29 to the fourth frame tube 19. The first and second tether lines include respective first and second turn buckles 31 and 33 to permit tensioning of the frame in its positioning, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water sled, comprising,

A first buoyancy tube and a second buoyancy tube arranged in a spaced parallel and coextensive relationship relative to one another, the first buoyancy tube having a first removable cap removably mounted relative to the first buoyancy tube, the second buoyancy tube including a second removable cap removably mounted relative to the second buoyancy tube to permit reception of ballast within the first buoyancy tube and the second buoyancy tube, and a tubular support frame mounted to the first buoyancy tube and the second buoyancy tube, wherein the tubular support frame includes a first frame tube fixedly secured to the first buoyancy tube, a second tube frame fixedly secured to the second buoyancy tube, a third frame tube extending orthogonally between the first frame tube and the second frame tube, and a fourth frame tube orthogonally and fixedly mounted between the first frame tube ,and the second frame tube and arranged in a parallel spaced relationship relative to the third frame tube, and a connecting rod fixedly and orthogonally mounted to the third frame tube projecting from the first frame tube medially of the first buoyancy tube and the second buoyancy tube, with a tow loop mounted to the connecting rod spaced from the third frame tube, and a support web positioned coextensively within the support frame, and including a plurality of tether lines securing the support web to the support frame, and a fifth frame tube extending orthogonally between the first frame tube and the second frame tube and medially of the third frame tube and the fourth frame tube, wherein the fifth frame tube extends above and beyond the support frame to provide for ease of manual manipulation of the support frame and for dividing cargo positioned upon the support web.

2. A water sled as set forth in claim 1 including a plurality of first anchor legs integrally mounted to the first frame tube and a plurality of second anchor legs fixedly mounted to the second frame tube, with one of said first anchor legs including a first post of a first length, and a further of said anchor legs including a second post of a second length greater than said first length, and one of said second anchor legs including a further first post of said first length and a further of said anchor legs including a further second post of said second length, and each said first post and each said second post pivotally mounted to respective first anchor leg and second anchor leg, and a continuous tarp frame including a cover web shield contained therewithin, wherein the tarp frame is secured to each first post and each second post, wherein the tarp frame is canted from the fourth frame tube towards the third frame tube, and a first tether line having a first turn buckle extending from the tarp frame to the third frame tube, and a second tether line having a second turn buckle extending from the tarp frame to the fourth frame tube.

* * * * *